US008398530B1

(12) United States Patent
Rubens

(10) Patent No.: US 8,398,530 B1
(45) Date of Patent: Mar. 19, 2013

(54) EXERCISE DEVICE

(76) Inventor: Efin Rubens, Brooklyn, NY (US)

( * ) Notice: Subject to any disclaimer, the term of this patent is extended or adjusted under 35 U.S.C. 154(b) by 0 days.

(21) Appl. No.: 12/927,198

(22) Filed: Nov. 10, 2010

Related U.S. Application Data

(60) Provisional application No. 61/281,958, filed on Nov. 25, 2009, provisional application No. 61/401,285, filed on Aug. 11, 2010.

(51) Int. Cl.
*A63B 21/00* (2006.01)
*A63B 21/068* (2006.01)

(52) U.S. Cl. ..... 482/131; 482/95; 482/908

(58) Field of Classification Search ..... 482/23, 482/38, 39, 69, 94, 95, 121, 131, 138, 144, 482/148, 904; 601/33, 34, 35
See application file for complete search history.

(56) References Cited

U.S. PATENT DOCUMENTS

| | | | | | |
|---|---|---|---|---|---|
| 1,410,149 | A * | 3/1922 | Williams et al. | 482/38 |
| 2,716,027 | A * | 8/1955 | Gehri | 482/131 |
| 3,982,756 | A * | 9/1976 | Hersey et al. | 482/131 |
| 4,084,815 | A * | 4/1978 | Flannery | 482/94 |
| 4,531,514 | A * | 7/1985 | McDonald et al. | 606/241 |
| 5,387,186 | A * | 2/1995 | Edland | 602/36 |
| 5,423,730 | A * | 6/1995 | Hirsch | 482/92 |
| 5,634,873 | A * | 6/1997 | Carlstrom | 482/95 |
| 6,416,447 | B1 * | 7/2002 | Harmon | 482/129 |
| 6,887,187 | B1 * | 5/2005 | Renz | 482/57 |
| 7,156,775 | B1 * | 1/2007 | Watry et al. | 482/17 |
| 7,255,666 | B2 * | 8/2007 | Cardenas | 482/143 |
| 7,857,736 | B2 * | 12/2010 | Merrithew et al. | 482/121 |
| 2002/0035016 | A1 * | 3/2002 | Weiss | 482/34 |

* cited by examiner

*Primary Examiner* — Oren Ginsberg

(57) ABSTRACT

An exercise device has a bar with attached two arms which press by their free ends with sharp elements against and dig into the ground on the left and right sides of person's body when person is laying on his back and together with rope block and rope with stirrups create support and leverage to lift person's legs and in some cases almost whole body above the ground in the air. Positioning the free ends of the arms in different places along a person's body gives possibility to redistribute tension between person's arms, legs and stomach muscles and creates different intensity of exercises. The numerous stretching and straining exercises can be accomplished by interaction between exercise device and person's legs and hands using body weight. The exercise device has freedom of movement and its arms' ends are not permanently connected to the ground or to anything else. The mobility of the device gives possibility to exercise while laying in bed for partially paralyzed persons to rehabilitate their condition without assistance. A few versions of this device can have capabilities of quick adjustment and to fold the device to a compact size.

11 Claims, 4 Drawing Sheets

EXERCISE DEVICE

I claim the benefit of the early filling dates of provisional applications: No. 61/281,958 filling date Nov. 25, 2009 and No. 61/401,285 filling date Aug. 11, 2010

BACKGROUND OF THE INVENTION

Different exercise devices are used to help the movements of body limbs, joints and muscles. Some of them are bulky and expensive, others difficult to use or need significant time to adjust or limited to exercise only one or few parts of the body. Purpose of this invention is to create a simple, portable, inexpensive exercise device which can exercise simultaneously many parts of the body using partial body weight and is easy and quick to change intensity and variety of exercises.

SUMMARY OF THE INVENTION

According to this invention the exercise device has a bar with attached two arms with sharp elements on their ends which press against and dig into the ground and together with rope block and rope with stirrups create support and leverage to lift person's legs and in some cases almost whole body above the ground in the air. The stretching and straining exercises can be accomplished by interaction between exercise device and person's legs and hands using partial body weight. Redistributing this body weight between hands, stomach muscles and leg muscles by using this device, helps to achieve numerous different exercises. Intensity and range of exercises can be easily and quickly adjusted without complicated setting by changing position of the device to the body. Exercises also can be made while laying in bed and because of this can be useful for rehabilitation after trauma, help to exercise for partially paralyzed persons or help for back pain, etc.

DETAIL DESCRIPTION OF THE INVENTION

Figure 1:
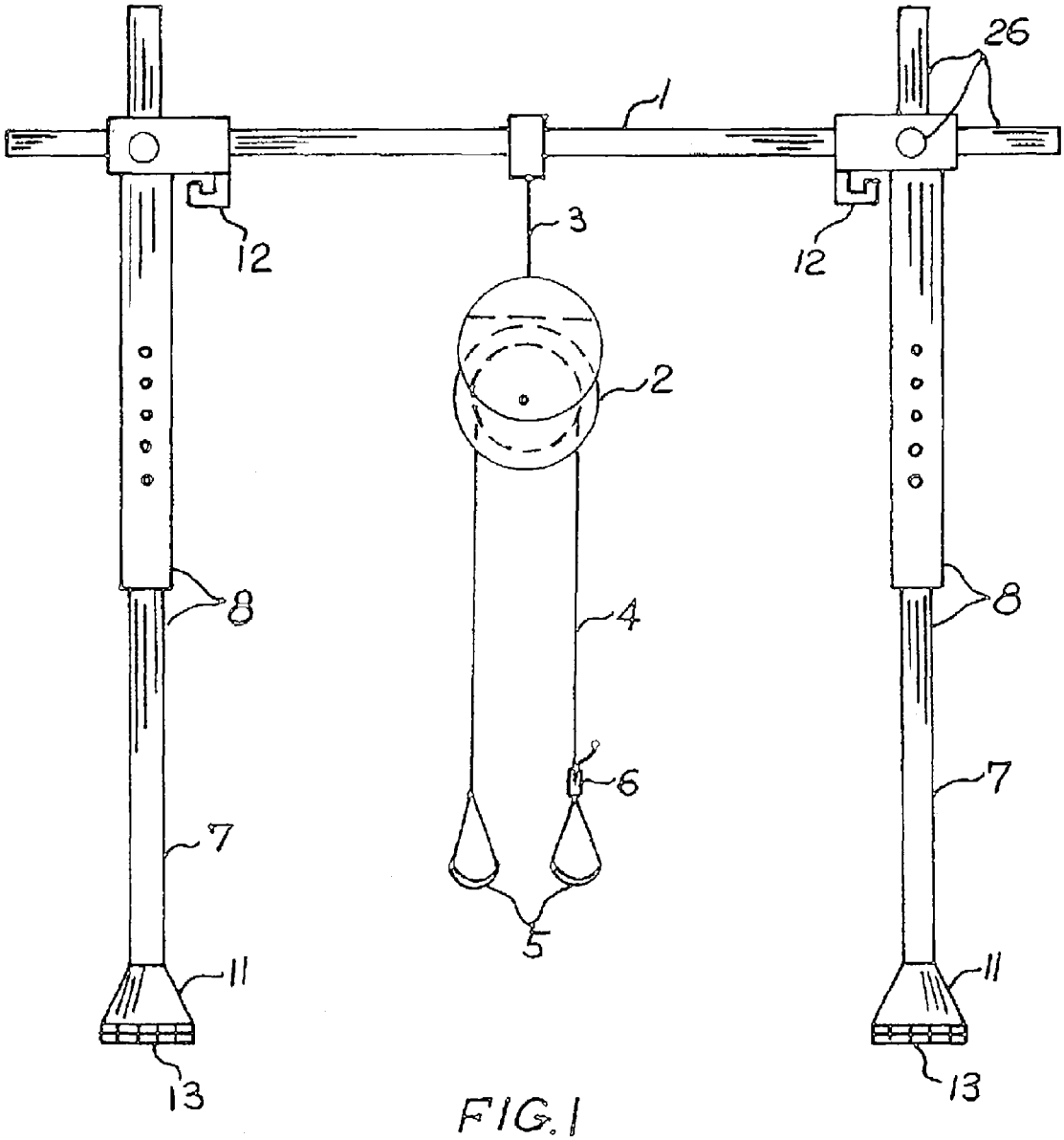
FIG. 1 is showing a front view of the exercise device.

Referring to FIG. 1, the exercise device has bar 1 and rope block 2 which has been attached by a rope 3 to the middle of a bar 1. This rope 3 permits the rope block to move freely in any direction without resistance. Nonelastic rope 4 winds around sheave of rope block 2 and has a stirrup 5 on each of the rope's ends. These stirrups can be made as flexible loops from the cloth belt or be made partially or completely from rigid plastic. The length of rope 4 can be adjusted according to person's size and desirable response between legs and hands. This can be achieved by buckle 6.

Two arms 7 are attached near perpendicular on both ends of the bar 1. These arms 7 can have a telescopic structure 8 and are capable to change their length. These arms can be permanently connected to bar 1 or can be made removable.

Two arms 7 can be at an angle to each other and can be extended on the top and connected by hinge, as shown and will be described on FIG. 2 and FIG. 3.

During exercise (see FIG. 4) a person lies on his back between two arms 7 and puts feet into stirrups 5. Free ends 11 of arms 7 placed on the ground in any desirable position in relation to the person's body and bar 1 or arms 7 are pulled by person's hands, so arms 7 rotate around ends 11, creating leverage and rope 4 with stirrups 5 lift a person's legs in the air. It creates resistance to person's hands and in the same time helps to accomplish different movements of the legs like stretching them apart, circular rotations of the legs, separate or together, etc. Combined forces from hands and legs push the ends 11 against the ground. Bar 1 and arms 7 can be supplied with series of hooks 12 are placed along them. The rope 4 can be attached to these hooks in different manners. Rope 4 then will bypass the block 2, decrease the working length of rope 4 and pulls stirrups 5 and the legs apart for variety of stretching exercises. If using hooks 12 near bars' 1 ends, the stirrups 5 will pull person's legs apart, and putting them together requires straining the muscles of the legs. If ends 11 placed on the ground closer to person's shoulders and the legs laid on the ground that will enable to pull up the top of the body. If one leg lays on the ground, the other leg can forcibly be pulled up. Person's legs, under support and/or resistance from hands can create wide range of motions including extreme stretching of the legs apart without excessive strain of stomach muscles. A variety of crunches, "levitation" (when almost whole body lifted above the ground) and other exercise can be accomplished. Also static or dynamic legs exercise, individual or both, with controllable interaction can be accomplished by redistributing muscle tension between legs, hands and stomach. This allows the person to make much more stretching repetitions and their durations than without the device. Numerous stretching of the legs can greatly improve legs circulation, poor prostate condition and flexibility of the body. Different ab exercises with adjustable resistance can be accomplished by using the device. Also, because a person can exercise while laying conveniently in bed, a partially paralyzed or physically weak person with limited mobility can make exercises by using this device.

Exercise device can be used in reverse mode when person's hands hold and pull stirrups 5. A person's legs are lifted in the air and pushed against bar 1. Moving hands apart and other numerous exercises can be achieved under resistance from the legs.

Depending on what kind of ground (bed top, carpet, etc.), the ends 11 of arms 7 can be provided with varieties of sharp elements 13 (as shown on FIGS. 1, 2, 3 and 5) which are digging into the ground and fixating the ends 11 on it in desirable position on the left and right side and along of the person's body during exercises. These sharp elements can have different shapes, like sharpened pins, serrations, sharpened blades or thin plates, with or without teeth. The term "sharp elements" are used to describe the shape of ends 11 and does not mean cutting sharp but thin points enough to dig slightly into a soft ground like carpet or bed top. The ends 11 can be also without sharp elements but this will significantly diminish the stability of the exercise device.

Figure 4:
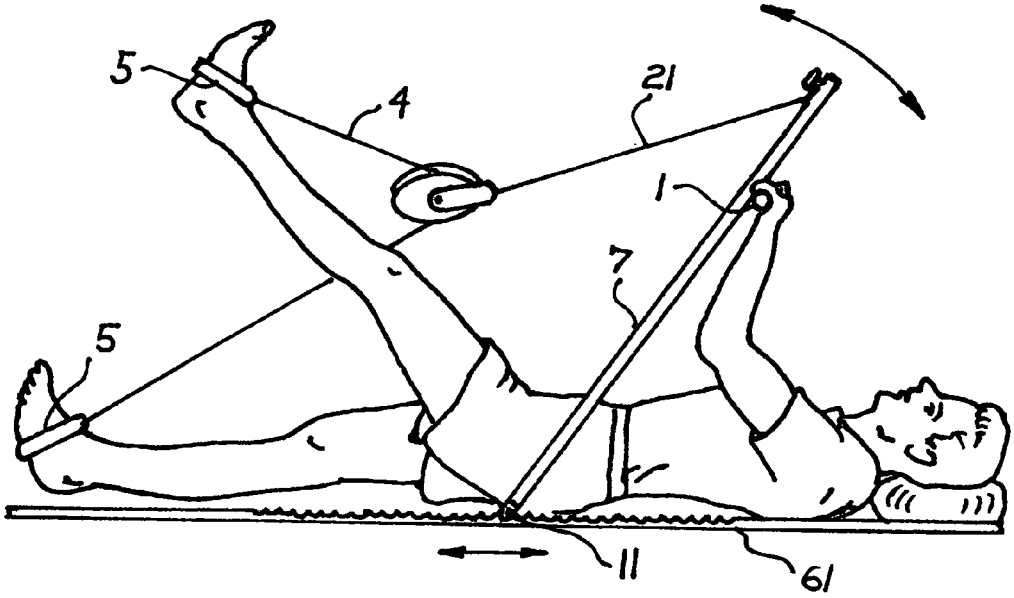
FIG. 4 is showing an exercise device in relation to a person during exercise.

A mat 61 with series of recesses or bumps can be placed on the ground to engage with free ends 11 to secure device on the ground in different positions during exercise (see FIG. 4).

Exercise device can be used also without pressing the arms 7 on the ground. In this case person's hands hold arms 7 to use them as an extension of hands which can give an additional range of motions.

The handles 26 can be attached to the arms or on the bar 1 in different places (FIG. 1). This gives possibility to customize the device for different personal preferences.

The ends 11 can have different shapes and can be attached to arms 7 when needed for different surfaces. The ends 11 (see FIG. 3) can be made like plates 27, plain or with teeth 28 (sharp elements), or plates can have tapered edges. These plates can be fixed without movement or can be pivotally attached for self-alignment on the ground. Also ends 11 can be spring loaded on arms 7 to stabilize them on uneven ground.

The bar 1 and two arms 7 can be manufactured as one piece of bended tubing and looks like reversed capital letter "U". In addition, the arms can have the telescopic structure 8 to adjust their length and can be made foldable by a hinge in the middle, to be compact when in storage. On FIGS. 2 and 3 "U"-shaped frame can consist of two straight or curved arms 7 which are connected to each other by hinge 41. The rope 21 in this case is attached to the device in its top in the area of hinge 41. The connection of rope 21 above the bar 1 gives possibility for bigger amplitude of motions. The bar 1 holds two arms 7 of "U"-shaped frame by hinges 42 in desirable position and prevents the arms from coming apart, creating rigged structure. Instead of hinges 42, screws or clamps can be used. A working length of the rope 21 can be adjusted by using one or more cleat cams (FIGS. 2 and 3). These cleat cams 44 pivotally placed into housing 45 and are spring loaded to help grab the rope 21 and squeeze it by the teeth of the cleats when force is applied to the rope 21. By pulling the rope 21 in one direction the rope will be grabbed by cam cleats and pulling in other direction will release the rope. Housing 45 can be attached in any places on the device for example in the middle of the bar 1 or on the arm 7 (shown by dotted lines on FIG. 3). A free end of piece of rope 21 can be pulled by hand to change its working length. By depressing the cleat cams by hands the rope can be released.

Other methods of quick adjustment of the rope 21 can be used, for example, a ratchet mechanism or slide with few fixing positions etc. The rope 3 on FIG. 1 also can be made adjustable.

Figure 2:
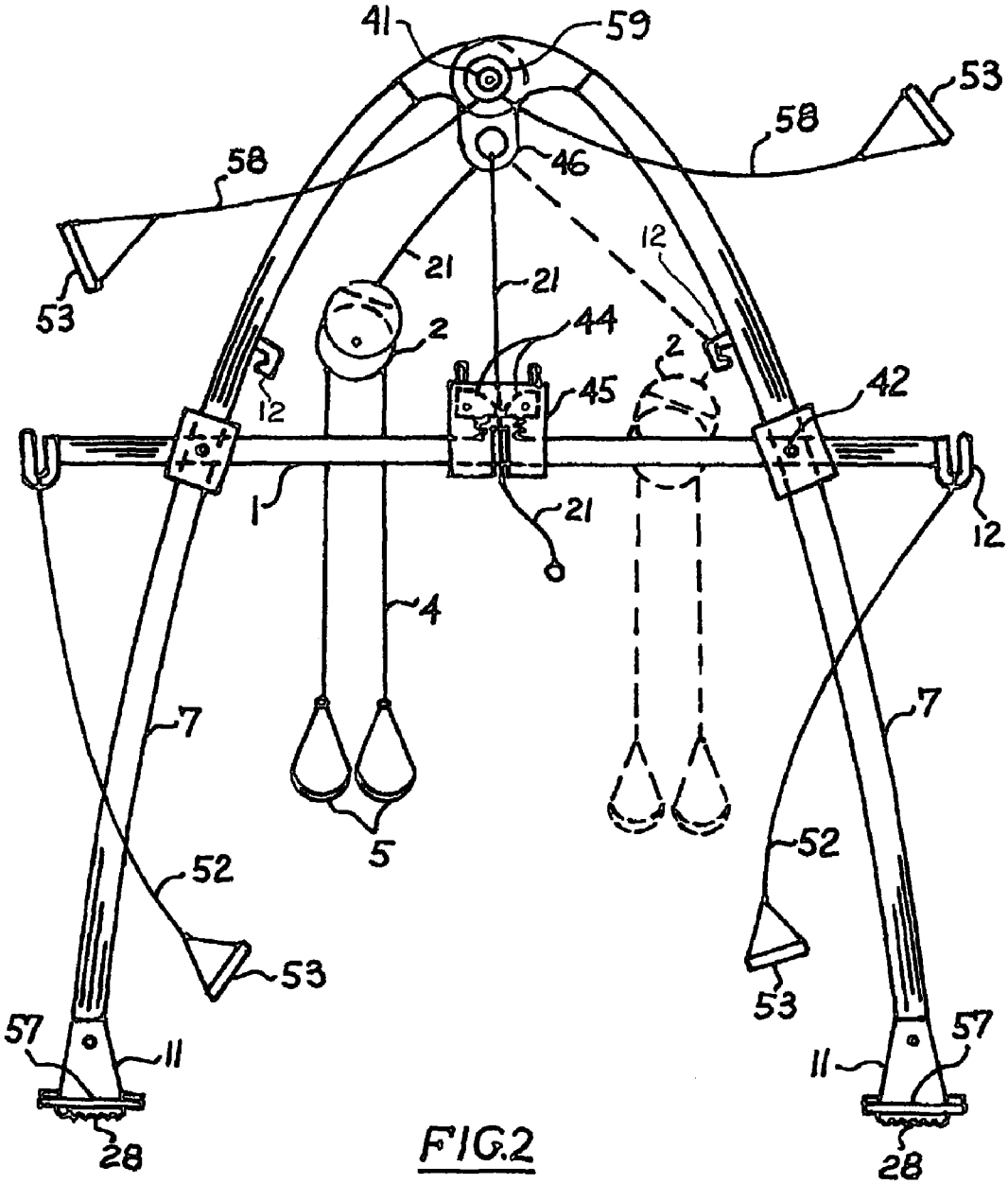
FIG. 2 is showing an embodiment of exercise device with an adjustable rope block.
Figure 3:
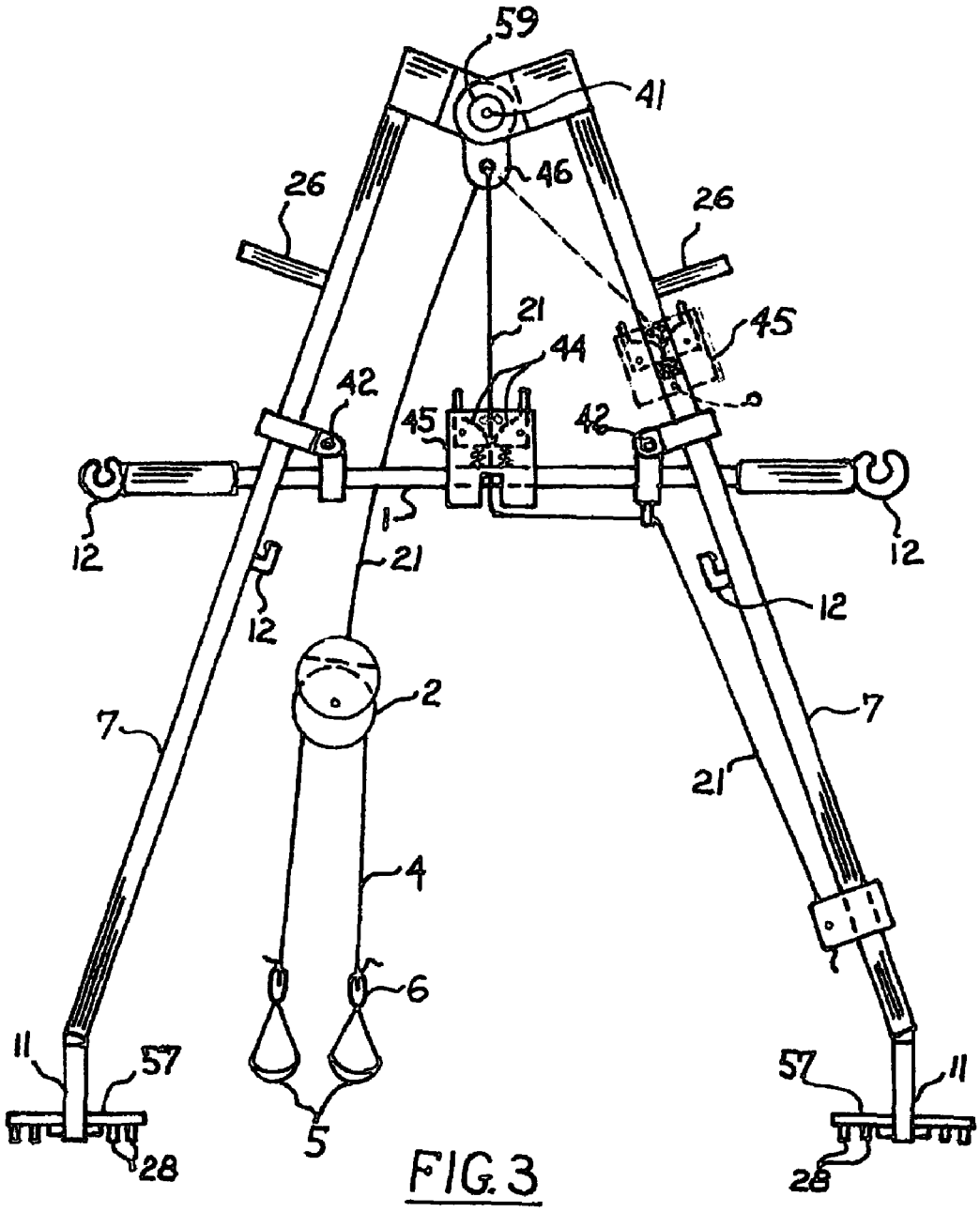
FIG. 3 is showing another version of the exercise device with the adjustable rope block.

A working length of piece of rope 21 means a distance from eye piece 46 to rope block 2 on FIGS. 2 and 3 or a distance between bar 1 and rope block 2 for FIG. 1.

The angle between bar 1 and arms 7 can be near 90 degree (FIG. 1) or under some suitable angle (FIGS. 2 and 3).

On FIG. 2 two ropes 52 can be connected to two opposite ends of bar 1 by the hooks 12 and be pulled by handles 53. These two ropes also can be connected in any other places of the device. The length of ropes 52 can be adjusted by winding them around the hooks 12 or around bar 1. Also rope 58 with attached to its ends handles 53 can be hooked in the middle of this rope to a protruded knob 59 and by pulling these handles a variety of exercises can be accomplished. The handles 53 with ropes 52 or rope 58 can be removed from the exercise device when not used.

Figure 5:
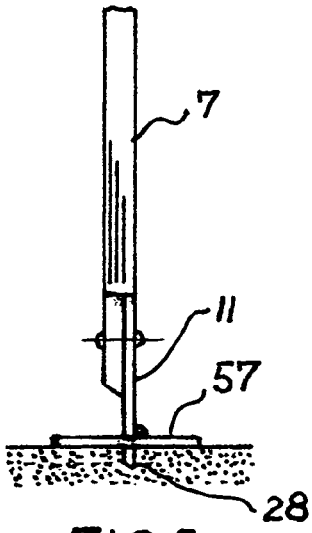
FIG. 5 is showing an arms end with a pivotal plate and sharp elements of FIG. 2.

All feature and elements on FIGS. 2, 3 and 5 can also be used for the devices on FIG. 1 and vice versa. When ground is soft and pliable, like sand or soil, a pivotal plates 57 with or without sharp elements 13 (teeth 28) can be attached to the ends 11 of arms 7 (FIGS. 2, 3 and 5) to prevent excessive penetration into the ground.

The intensity of exercises can be increased also by attaching additional weight to a person's legs or put a pad under person's buttocks.

The bar 1 on all versions of the device can be straight or can have curved shape with protruding portions to create comfortable grip and accommodate the device for person's body in the middle of the bar 1 during exercises.

The rope block 2 with rope 21 can be hooked by one of the hooks 12 on the right or on the left side of the device (as shown on FIG. 2 by dotted lines). This asymmetrical position of the rope block will create additional side force to the right or to the left during exercise.

All of the versions of the exercise device have one thing in common: two arms 7 and their ends on the ground on the left and on the right sides from person's body can move freely along the body and do not attach to anything permanently although as an option the device can be pivotally attached by ends 11 to other equipment if needed.

The foregoing description of the preferred embodiment of the invention has been presented for the purpose of illustration and description. It is not intended to be exhaustive or to limit the invention to the precise form disclosed. Many modifications and variations are possible in light of the above teaching. It is intended that the scope of the invention be limited not only by this detailed description, but rather by the claims appended hereto.

I claim:

1. An exercise device for enabling a full range of free motions providing an upper and lower body workout to a person laying on his back by pulling and manipulating the exercise device, comprising:

a bar having a first end and an opposite end opposing the first end;

a pair of substantially elongated arms both arranged in the same plane, each of the arms having a first free end and a second opposing end;

the bar attached to the pair of arms, wherein the first end of the bar is attached to the second opposing end of one arm of the pair of arms and the opposite end of the bar is attached to the second opposing end of the other arm of the pair of arms, the pair of arms are symmetrically disposed with respect to each other about the middle of the bar;

the first free ends of the pair of the arms are disposed apart from one another such that the first free ends of the pair of arms are configured to press against the ground on the left side and on the right side of the person's body when the person is laying on his back under the bar and between the pair of arms and engaged with the exercise device;

a rope block attached to the middle of the bar by a piece of rope allowing free movement of the rope block; and a pair of stirrups attached to a rope passed through the rope block, wherein the stirrups are attached to opposing ends of the rope, each stirrup of the pair of stirrups is configured to accept a foot of the person.

2. The exercise device according to claim 1, comprising a plurality of sharp elements attached to each first free end of the pair of arms and configured to dig into the ground to prevent slippage of the exercise device during use.

3. The exercise device according to claim 1, comprising a plate with a plurality of sharp elements pivotally attached to each the first free end of the pair of arms and configured to dig into the ground to prevent slippage of the exercise device during use.

4. The exercise device according to claim 1, comprising a plate pivotally attached to each the first free end of the pair of arms.

5. The exercise device according to claim 1, comprising a plurality of hooks disposed on the bar and the pair of arms configured to attach ropes or belts for different exercises.

6. An exercise device for enabling a full range of free motions providing an upper and lower body workout to a person laying on his back by pulling and manipulating the exercise device, comprising:

a bar having a first end and an opposite end opposing the first end;

a pair of substantially elongated arms both arranged in the same plane, each of the arms having a first free end and a second opposing end, the pair of arms are pivotally connected to one another at a hinge located at the second opposing ends of the pair of arms, the pair of arms are symmetrically disposed with respect to each other about the hinge and the middle of the bar;

the bar attached to the pair of arms, wherein a portion of the bar some distance to the first end of the bar is attached to a middle portion of one of the pair of arms and a portion of the bar some distance to the opposite end of the bar is attached to a middle portion of the other arm of the pair of the arms;

the first free ends of the pair of the arms are disposed apart from one another such that the first free ends of the pair of arms are configured to press against the ground on the left side and on the right side of the person's body when the person is laying on his back under the bar and between the pair of arms and engaged with the exercise device;

a rope block connected to one end of a piece of rope, the piece of rope attached movably near the top of the exercise device allowing free movement of the rope block, the piece of rope further passes through a housing and cleat cams to hold the piece of rope when the piece of rope pulled in one direction and to release the piece of rope when pulled in opposite direction, the housing is attached to the bar or on one of arm of the pair of arms; and a pair of stirrups attached to a rope passed through the rope block, wherein the stirrups are attached to opposing ends of the rope, each stirrup of the pair of stirrups is configured to accept a foot of the person.

7. The exercise device according to claim 6, comprising a sharp elements attached to each the first free end of the pair of arms and configured to dig into the ground to prevent slippage of the exercise device during use.

8. The exercise device according to claim 6, comprising a plate with sharp elements pivotally attached to each the first free end of the pair of arms and configured to dig into the ground to prevent slippage of the exercise device during use.

9. The exercise device according to claim 6, wherein the pair of arms has telescopic structure for adjustment the length of the arms.

10. The exercise device according to claim 6, comprising a pair of handles attached to the device by ropes or belts for different exercises.

11. An exercise device for enabling a full range of free motions providing an upper and lower body workout to a person laying on his back by pulling and manipulating the exercise device, comprising:

a bar having a first end and an opposite end opposing the first end;

a pair of substantially elongated arms both arranged in the same plane, each of the arms having a first free end and a second opposing end, the pair of arms are pivotally connected to one another at a hinge located at the second opposing ends of the pair of arms, the pair of arms are symmetrically disposed with respect to each other about the hinge and the middle of the bar;

the bar attached to the pair of arms, wherein a portion of the bar some distance to the first end of the bar is attached to a middle portion of one arm of the pair of arms and a portion of the bar some distance to the opposite end of the bar is attached to a middle portion of the other arm of the pair of the arms;

the first free ends of the pair of the arms are disposed apart from one another such that the first free ends of the pair of arms are configured to press against the ground on the left side and on the right side of the person's body when the person is laying on his back under the bar and between the pair of arms and engaged with the exercise device;

a rope block connected to one end of a piece of rope, the piece of rope attached movably near the top of the exercise device allowing free movement of the rope block, the piece of rope further passes through a housing and cleat cams to hold the piece of rope when the piece of rope pulled in one direction and to release the piece of rope when pulled in opposite direction, the housing is attached to the bar or on one arm of the pair of arms;

a pair of stirrups attached to a rope passed through the rope block, wherein the stirrups are attached to opposing ends of the rope, each stirrup of the pair of stirrups is configured to accept a foot of the person;

a plate with a plurality of sharp elements pivotally attached to each the first free end of the pair of arms and configured to dig into the ground to prevent slippage of the exercise device during use; and a plurality of hooks disposed on the bar and the pair of arms configured to attach ropes or belts. for different exercises.

* * * * *